US006443388B1

(12) United States Patent
Hollinger

(10) Patent No.: US 6,443,388 B1
(45) Date of Patent: Sep. 3, 2002

(54) DISPOSABLE TOWEL HOLDER WITH SUCTION CUP

(75) Inventor: Fred Hollinger, Kings Park, NY (US)

(73) Assignee: E & B Giftware LLC

( * ) Notice: Subject to any disclaimer, the term of this patent is extended or adjusted under 35 U.S.C. 154(b) by 0 days.

(21) Appl. No.: 09/840,645

(22) Filed: Apr. 23, 2001

Related U.S. Application Data

(63) Continuation-in-part of application No. 09/586,296, filed on Jun. 2, 2000, now Pat. No. 6,405,973.

(51) Int. Cl.[7] ..... B65H 16/04
(52) U.S. Cl. ..... 242/597.7; 242/591
(58) Field of Search ..... 242/597.7, 597.4, 242/596.8, 597.5, 597.6, 597.8, 591, 593, 599.4, 599.3; D6/522, 523, 512; 221/63, 33, 45, 96; 206/494, 390, 524.1, 408, 416

(56) References Cited

U.S. PATENT DOCUMENTS

| | | | |
|---|---|---|---|
| 2,315,566 | A | 4/1943 | Watral et al. |
| 2,641,415 | A | 6/1953 | Moriarty |
| D176,842 | S | 2/1956 | Path |
| 3,079,099 | A | 2/1963 | Blain |
| 3,227,386 | A | 1/1966 | Pitcher |
| 3,240,461 | A | 3/1966 | Singleton |
| 3,276,734 | A | 10/1966 | Goldblatt |
| 3,638,878 | A | 2/1972 | Morris |
| 3,750,991 | A | 8/1973 | Ragir |
| 3,892,369 | A | 7/1975 | Fujawa |
| 4,012,007 | A | 3/1977 | Cunningham |
| 4,117,936 | A | 10/1978 | Dawson |
| 4,298,126 | A | 11/1981 | Filipowicz |
| 4,316,588 | A | 2/1982 | Walthall et al. |
| 4,432,451 | A | 2/1984 | Hooser |
| 4,565,335 | A | 1/1986 | Rankin |
| 4,580,751 | A | 4/1986 | Panzer |
| 4,694,973 | A | 9/1987 | Rose et al. |
| 4,813,640 | A | 3/1989 | Perentin |
| 4,896,954 | A | 1/1990 | Swanson |
| 5,040,679 | A | 8/1991 | Rehmann |
| 5,087,005 | A | 2/1992 | Holoff et al. |
| 5,183,220 | A | 2/1993 | Cencula |
| 5,297,750 | A | 3/1994 | Hunt |
| 5,318,262 | A | 6/1994 | Adams |
| 5,495,884 | A | 3/1996 | Shikler |
| 5,544,839 | A | 8/1996 | Burch |
| 5,592,244 | A | 1/1997 | Vyhmeister |
| 5,630,517 | A | 5/1997 | Maznik |
| 5,649,634 | A | 7/1997 | Irizarry |
| D390,054 | S | 2/1998 | Goodman |
| D395,567 | S | 6/1998 | Hollinger |
| 5,779,066 | A | 7/1998 | Drower et al. |
| D397,587 | S | 9/1998 | Hollinger |
| 5,862,816 | A | 1/1999 | Lowe |
| D412,803 | S | 8/1999 | Goodman et al. |
| 5,996,950 | A | 12/1999 | Richter |
| 6,142,432 | A | 11/2000 | Amussen |
| 6,143,391 | A | 11/2000 | Barnes et al. |
| D438,067 | S | 2/2001 | Goodman et al. |
| 6,193,197 | B1 | 2/2001 | Lian |
| 6,308,923 | B1 | 10/2001 | Howard |

*Primary Examiner*—William A. Rivera
(74) *Attorney, Agent, or Firm*—Gerard F. Dunne

(57) ABSTRACT

A holder for a roll of disposable towels has a base and an upstanding member extending upwardly from the base to be inserted into the hollow core of a roll of disposable towels or the like. A suction cup is held to the underside of the base for holding the base securely to a surface such as a counter top upon removal of the towels from the roll. The suction cup has upstanding portions engaging the underside of the base to enable the suction cup to be depressed by movement of the holder downwardly. In preferred form, the base has an opening for receiving a tab connected to the suction cup for releasing the suction cup from the surface.

15 Claims, 6 Drawing Sheets

DISPOSABLE TOWEL HOLDER WITH SUCTION CUP

PRIOR APPLICATION

This application is a continuation-in-part of application Ser. No. 09/586,296 filed Jun. 2, 2000 now U.S. Pat. No. 6,405,973.

FIELD OF THE INVENTION

The present invention relates to a holder for disposable towels such as paper towels, and the holder has a suction cup attached to its base to secure the holder to a counter top upon removal of the disposable towels.

BACKGROUND OF THE INVENTION

Holders for disposable towels such as paper towels are well-known; and often the holders are secured to the underside of a kitchen cabinet or the like to provide a convenient means for removing the towels from the roll by pulling on the last towel to separate perforations. Holders for disposable towels have also been provided which may be placed upon a counter top; and often the roll of disposable towels are held vertically to save counter space. Unfortunately, such vertical holders for disposable towels are often unstable when a paper towel is attempted to be torn from the roll. In one proposed vertical holder for paper towels described in U.S. Pat. No. 4,012,007, a large base is provided for stability. The use of a larger base, however, requires additional counter space beyond the lateral extent of the roll of paper towels and an advantage of a vertical paper towel holder is diminished.

It is, therefore, an object of the present invention to provide a holder for a roll of disposable towels which may be placed vertically on a surface such as a counter top with minimal use of counter space and yet may be held to the counter top upon attempting to tear a disposable towel from the roll.

SUMMARY OF THE INVENTION

According to the present invention, a holder for a roll of disposable towels has a base and an upstanding member extending upwardly from the base to be inserted into the hollow core of the roll of towels. A suction cup is held to the underside of the base and adapted to be depressed downwardly by movement of the holder for holding the base securely to a surface such as a counter top in order to facilitate removal of the towels from the roll. The upper surface of the suction cup has upstanding portions to engage the undersurface of the base to depress the suction cup assuredly upon downward movement of the holder. In this way, holder can be secured to a counter top and yet the base need extend only to the expected extent of the periphery of the roll of paper towels.

In a preferred form of the present invention, the base has an opening, and a tab upstanding from the suction cup extends through the opening for enabling the suction cup to be released from the surface.

These and other objects, advantages and features of the present invention will become apparent from the description given below of a preferred embodiment, which description is made in conjunction with the following drawing figures.

Figure 1:
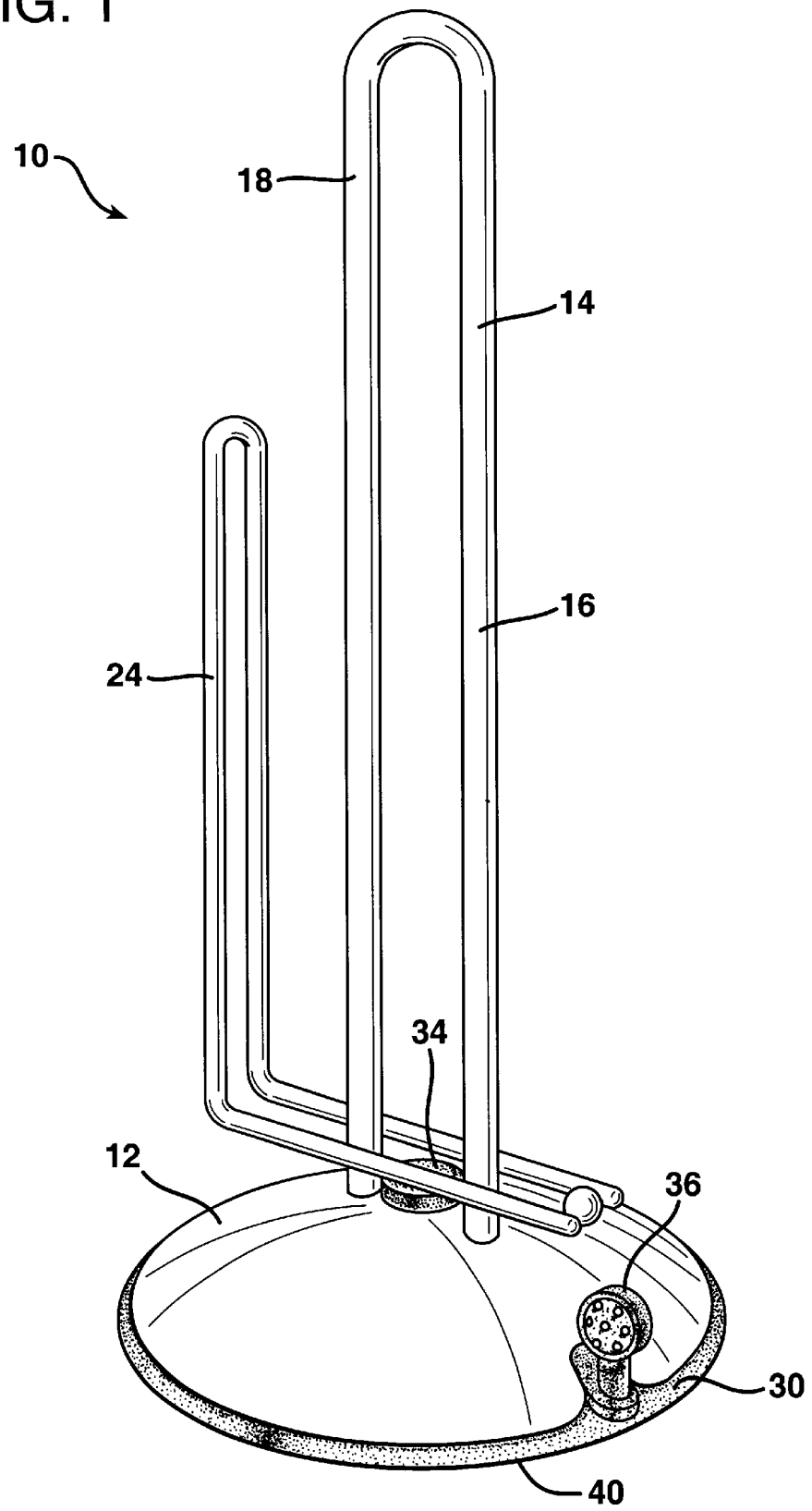
FIG. 1 is a perspective view of a disposable towel holder of the present invention.
Figure 2:
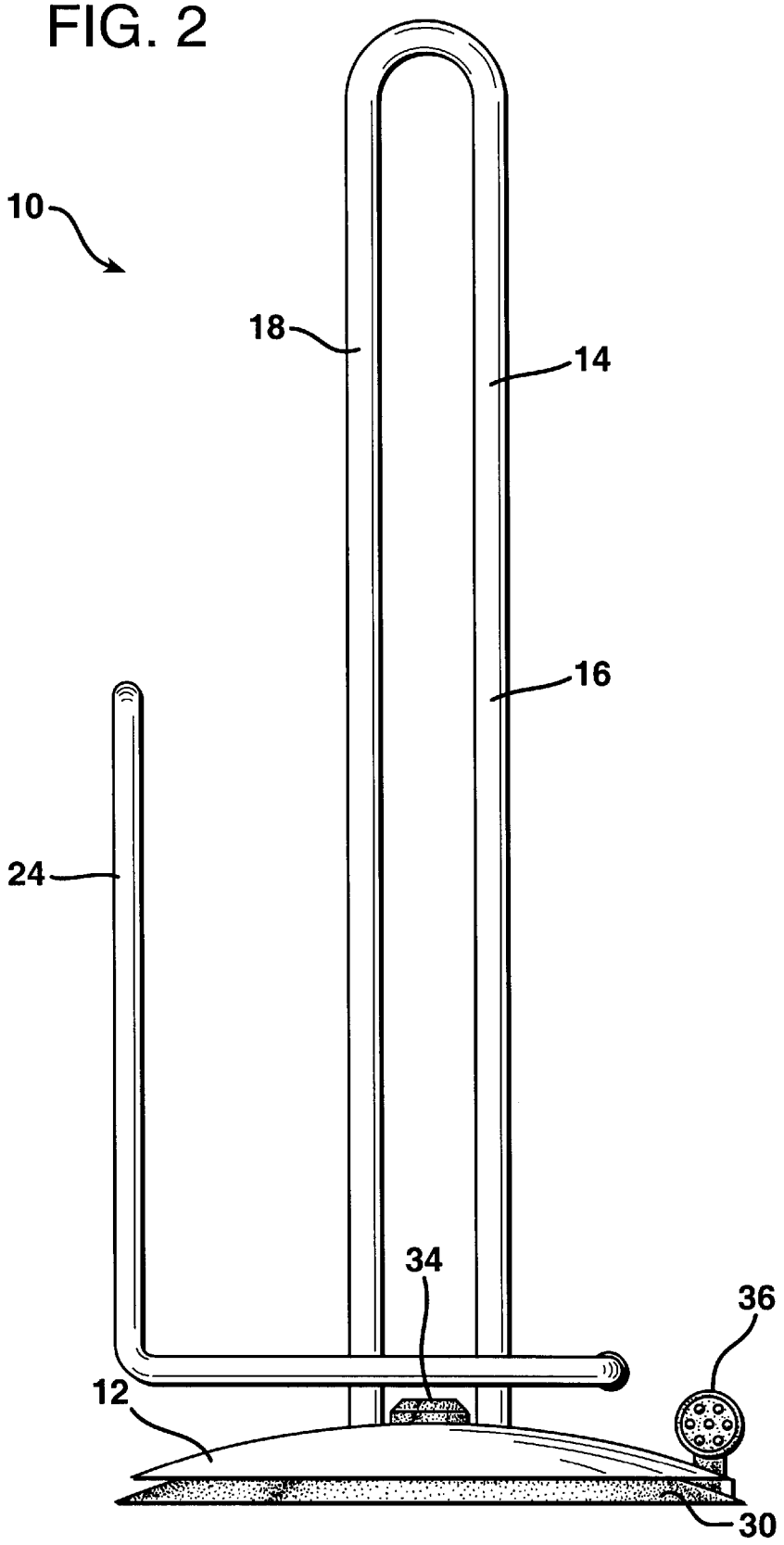
FIG. 2 is a side elevational view of a disposable towel holder of the present invention.
Figure 3:
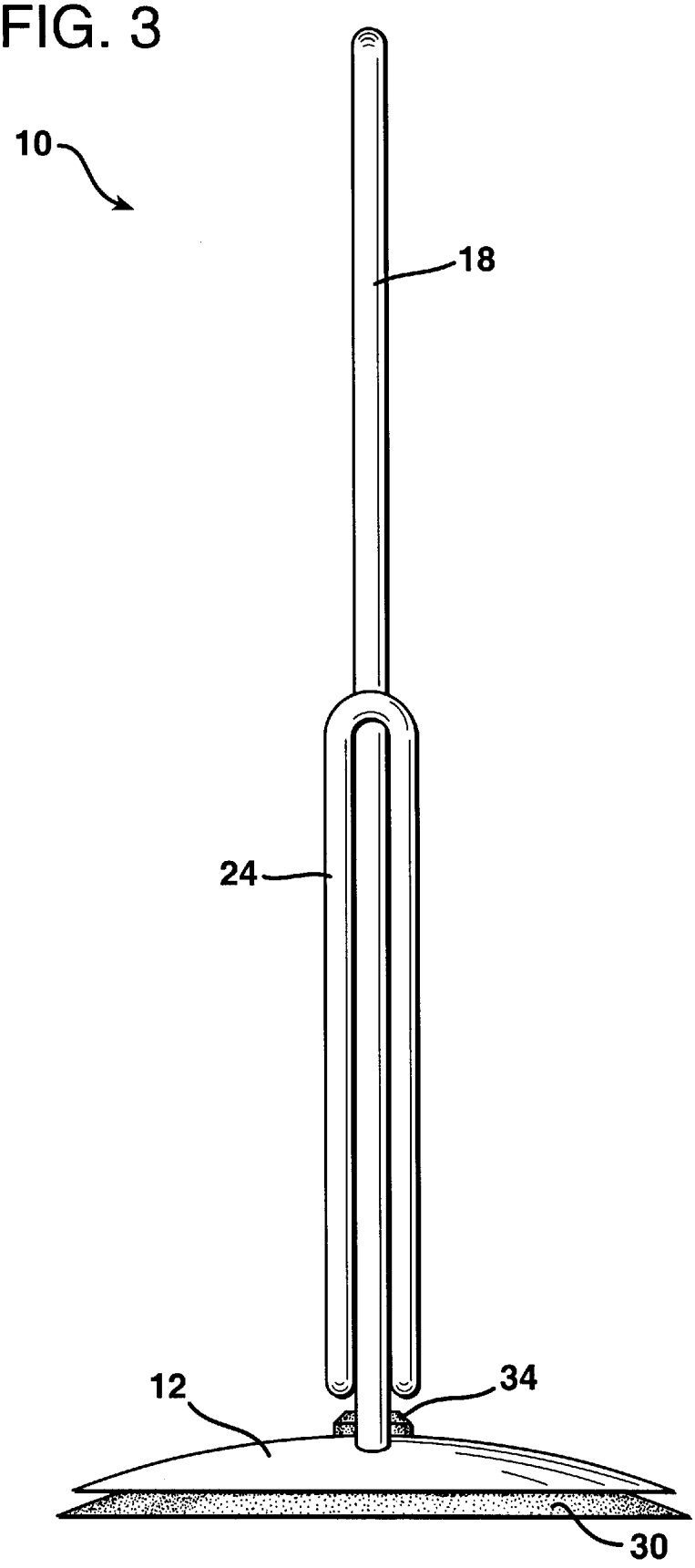
FIG. 3 is a front elevational view of the disposable towel holder of FIG. 1.
Figure 4:
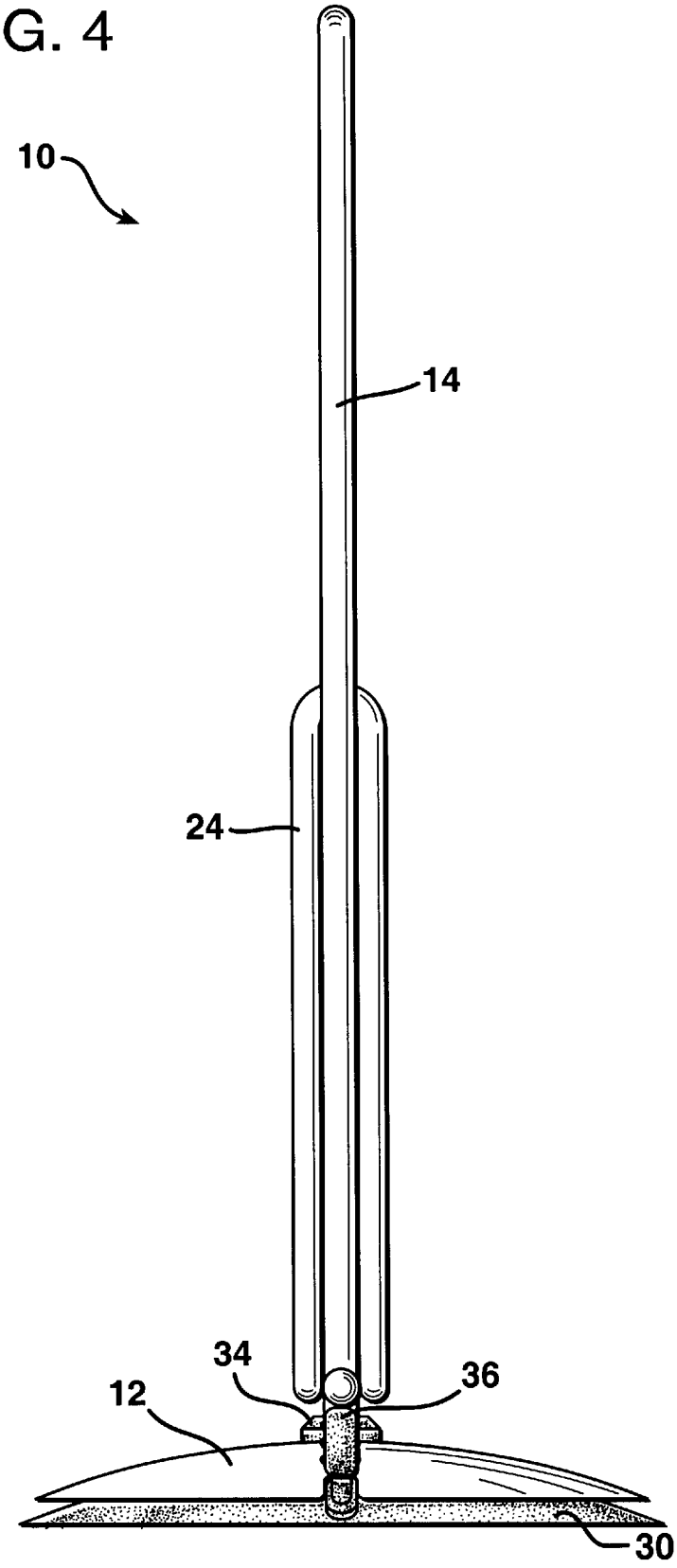
FIG. 4 illustrates the rear elevational view of a paper towel holder according to the present invention.
Figure 5:
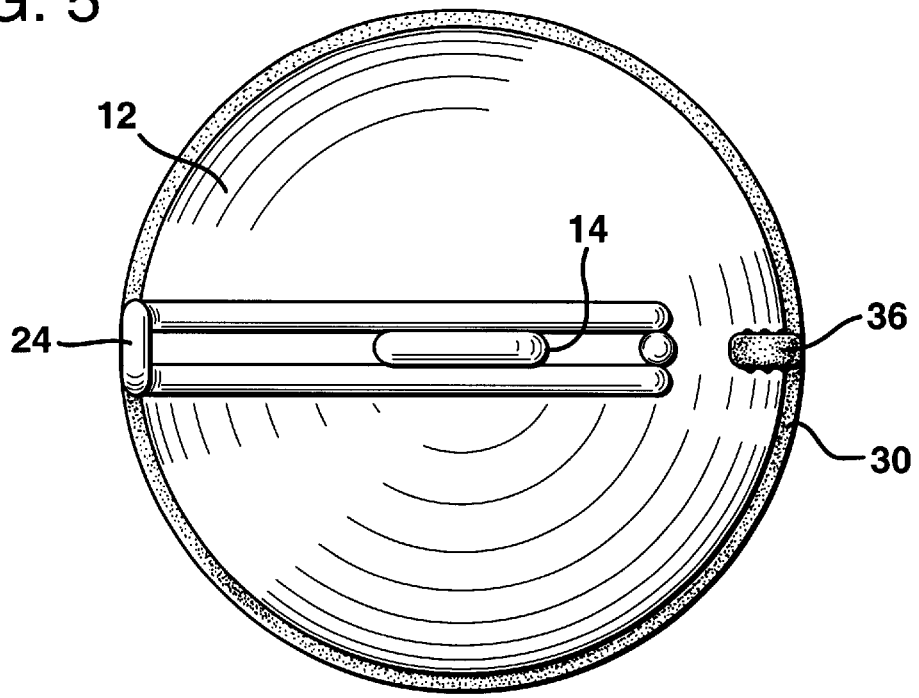
FIG. 5 is a top view of the disposable towel holder of the present invention.
Figure 6:
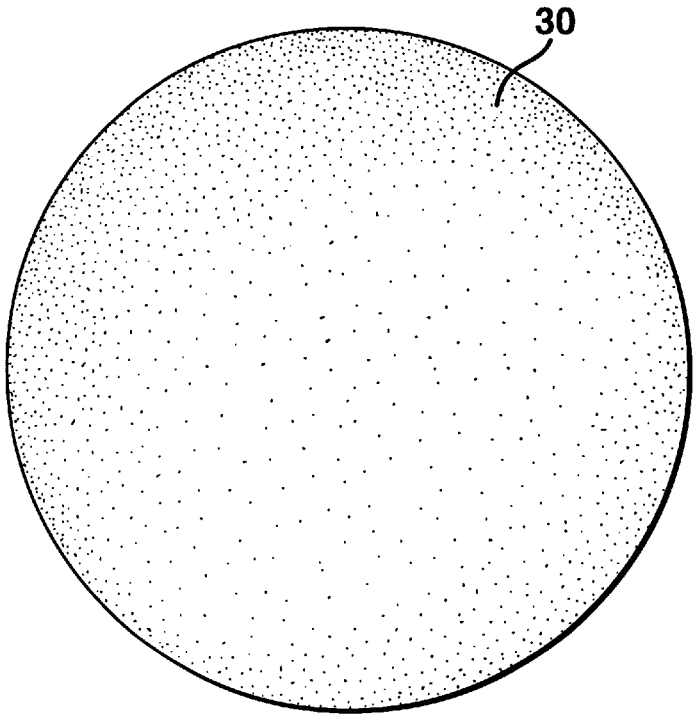
FIG. 6 is a bottom view thereof.

As illustrated in FIG. 1, a disposable towel holder 10 of the present invention includes a domed base 12 having an upstanding member 14 adapted to be inserted into the hollow core of a roll of disposable towels; such as paper towels.

Figure 7:
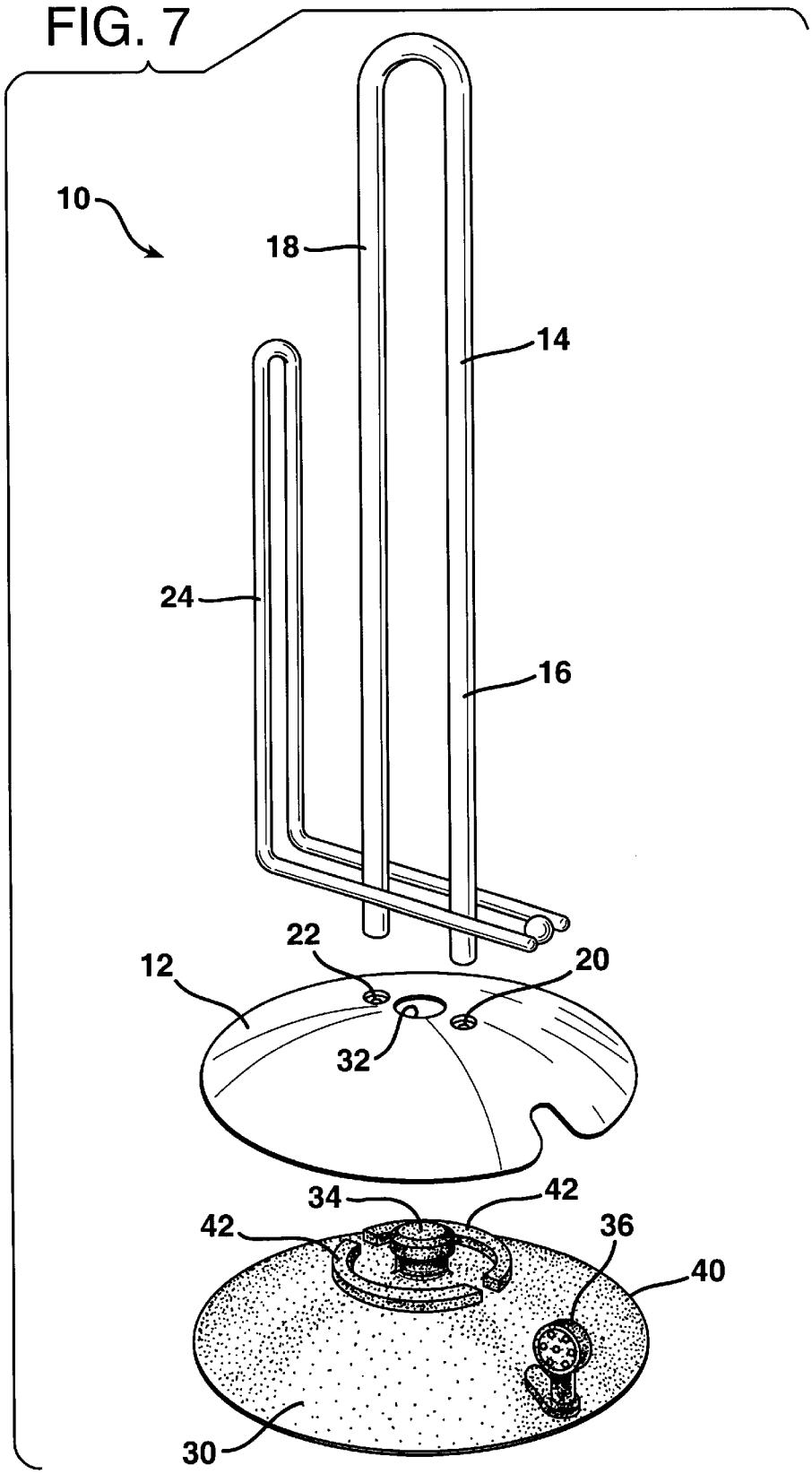
FIG. 7, illustrates the disposable towel holder of the present invention in exploded form.

The upstanding member 14 is formed of two prongs 16 and 18 which are connected at their upper portions; and as illustrated in FIG. 7, the lower ends of the prongs 16 and 18 may be press fitted into complimentary openings 20 and 22 formed in the base 12.

Additionally, the holder of the present invention includes a sidebar 24 adapted to engage the expected periphery formed by the outer surface of the roll of disposable towels; and the sidebar 24 is held fixedly to the lower portion of the prongs 16 and 18.

As would be well understood in the art, the hollow core of a roll of disposable towels may be inserted over the prongs 16 and 18 with the sidebar 24 engaging the outer surface of the roll to hold the roll of disposable towels reliably to the paper towel holder 10.

In use, a disposable towel which is connected to the roll through perforations would be grasped by the user and pulled to separate the disposable towel at the perforations; and this may cause the paper towel holder 10 to move along the counter top or even tilt rapidly toward the user who may be tugging on a disposable towel on the roll.

In order to secure the paper towel holder 10 to a counter top or the like, fitted beneath the base 12 is an elastomeric device to provide suction; and preferably a dome-shaped suction cup 30 formed of an elastomeric material conforming to the contour of the base 12 is fitted to the base. As can be seen in FIG. 7, a central opening 32 is formed within the domed-shaped base 12; and an upstanding elastomeric knob 34 extends upwardly from the central portion of the suction cup 30 and has an enlarged end portion which may be compressed and inserted through the opening 32 to secure the suction cup 30 in position beneath the base 12.

As an important feature of the present invention, the suction cup 30 has upstanding projections 42 preferably formed as ridges adapted to engage the undersurface of the base 12. In this way, downward movement of the holder 10 will cause the base 12 to press is firmly against the projections 42 and assuredly depress the suction cup to a counter top or the like. The projections 42 may, as illustrated, be a pair of semi-circular ridges arranged concentrically around the knob 34.

A tab 36 is connected integrally to the suction cup 30; and extends upwardly through a slotted opening 38 in the base 12. In use, the disposable towel holder 10 may be secured and placed on a surface such as a counter top by being pressed forcibly downward to provide a suction gripping the counter top; and the suction can be released by the user simply grasping the tab 36 and lifting to separate a lip 40 of the suction cup from the counter surface to release the suction and enable the disposable towel holder to be removed.

These and other objects, advantages and features of the present invention will be understood from the detailed description of a preferred embodiment made above; however, the present invention is not limited by any details of the above but is set forth by the appended claims.

What is claimed is:

1. In a holder for a roll of disposable towels, said roll having a hollow central core and an outer periphery, said holder having a base, an upstanding member extending upwardly from said base and adapted to be inserted into said core; and a suction cup held beneath said base and adapted to be depressed by downward movement of the holder for holding the base securely to a surface for removal of towels from the roll, said suction cup having projections extending upwardly from said suction cup and adapted to be engaged by the underside of said base upon downward movement of the holder.

2. A holder as set forth in claim 1, said base being domed shape to conform generally to the contours of said suction cup.

3. A holder for a roll of disposable towels as set forth in claim 2, said base having an opening, and a tab upstanding from said suction cup and through said opening for releasing the suction cup from the surface.

4. A holder for a roll of disposable towels as set forth in claim 1, said suction cup having an upstanding knob adapted to be fitted through a central opening in said base, said projections being formed by a pair of semi-circular ridges arranged concentrically about said knob.

5. A holder as set forth in claim 1, said base being domed shape to conform generally to the contours of said suction cup and extending laterally to end at the extent of the outer periphery of said roll.

6. A holder as set forth in claim 1, including an upstanding sidebar positioned laterally of said member and adapted to engage the lateral extent of the roll, said base extending laterally to end at the extent of the outer periphery of said roll.

7. In a holder for a roll of disposable towels, said roll having a hollow central core and an outer periphery, said holder having a domed-shaped base, an upstanding member extending upwardly from said base and adapted to be inserted into said core; and a suction cup having a contour conforming to the domed-shaped contour of the underside of said base and held beneath base, and upstanding projections formed on an upper surface of said suction cup and adapted to engage the undersurface of said base upon downward movement of said holder so that said suction cup maybe depressed by downward movement of the holder for holding the base securely to a surface for removal of towels from the roll.

8. A holder as set forth in claim 7, including an upstanding sidebar positioned laterally of said member and adapted to engage the lateral extent of the roll, said base extending laterally to the extent of the outer periphery of said roll.

9. In a holder for a roll of disposable towels, said roll having a hollow central core and an outer periphery, said holder having a base, an upstanding member extending upwardly from a central portion of said base and adapted to be inserted into said core; and a suction cup held to the underside of the central portion of said base and adapted to be depressed by downward movement of the holder for holding the base securely to a supporting surface for removal of towels from the roll, said suction cup having projections extending upwardly from said suction cup and adapted to be engaged by the underside of said base upon downward movement of the holder.

10. A holder as set forth in claim 9, said suction cup having a dome-shaped contour and said base being domed shaped to conform generally to the contours of said suction cup.

11. A holder for a roll of disposable towels as set forth in claim 10, said base having an opening, and a tab upstanding from said suction cup and through said opening for releasing the suction cup from the supporting surface.

12. A holder for a roll of disposable towels as set forth in claim 9, said base having an opening, and a tab upstanding from said suction cup and through said opening for releasing the suction cup from the supporting surface.

13. A holder as set forth in claim 9, said suction cup having a dome-shaped contour, and said base being domed shaped to conform generally to the contours of said suction cup and extending laterally to end at the expected extent of the outer periphery of said roll.

14. A holder for a roll of disposable towels as set forth in claim 13, said base having an opening, and a tab upstanding from said suction cup and through said opening for releasing the suction cup from the surface.

15. A holder as set forth in claim 9, including an upstanding side bar positioned laterally of said member and adapted to engage the lateral extent of the roll, said base extending laterally to end at the extent of the outer periphery of said roll.

* * * * *